US005094367A

United States Patent [19]

Chatourel

[11] Patent Number: 5,094,367

[45] Date of Patent: Mar. 10, 1992

[54] OPENING-CLOSING DEVICE FOR A BAG OF FLEXIBLE SYNTHETIC MATERIAL HAVING A FINGER GRIPPING PORTION

[75] Inventor: Daniel Chatourel, Vittel, France

[73] Assignee: Societe Generale des Eaux Minerals de Vittel, Vittel, France

[21] Appl. No.: 370,382

[22] Filed: Jun. 22, 1989

[30] Foreign Application Priority Data

Jun. 22, 1988 [FR] France ..... 88 08567

[51] Int. Cl.[5] ..... B65D 17/44

[52] U.S. Cl. ..... 222/566; 220/278; 222/91; 222/107; 222/562; 222/575; 383/80; 383/96

[58] Field of Search ..... 222/81, 83.5, 91, 105, 222/106, 107, 562, 566, 575; 383/80, 96, 906; 220/278, 258; 215/250, 252

[56] References Cited

U.S. PATENT DOCUMENTS

| | | | |
|---|---|---|---|
| Re. 32,354 | 2/1987 | Savage | 222/81 |
| 3,339,812 | 9/1967 | Meissner | 220/278 X |
| 4,202,469 | 5/1980 | Brandt | 222/91 |
| 4,440,316 | 4/1984 | Christine | 222/83.5 |
| 4,776,488 | 10/1988 | Gurzan | 222/81 |

FOREIGN PATENT DOCUMENTS

| | | | |
|---|---|---|---|
| 2554785 | 8/1986 | France . | |
| 2600974 | 9/1988 | France . | |
| 257289 | 4/1964 | Netherlands | 220/278 |

*Primary Examiner*—Kevin P. Shaver
*Attorney, Agent, or Firm*—Weiser & Stapler

[57] ABSTRACT

An opening-closing device for a flexible containing a liquid includes a cylindrical spout attached to the outer surface of the bag, and a stopper for the spout which includes a blade for perforating an area of the bag located within the spout when the bag is to be opened. An arrangement of tongues or wings extend from the sides of the spout so that a user may grip the tongue or wing while perforating the area of the bag within the spout upon insertion of the stopper.

14 Claims, 3 Drawing Sheets

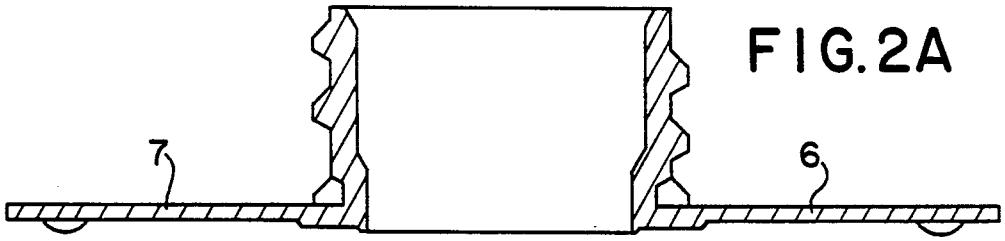
FIG. 2A
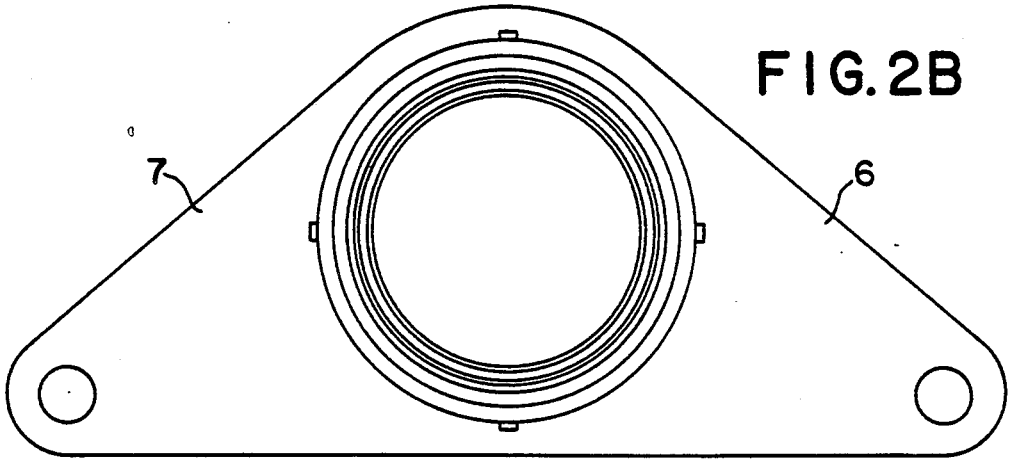
FIG. 2B
FIG. 4A
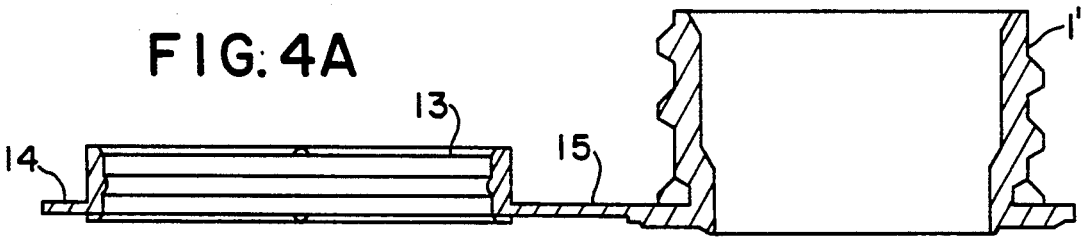
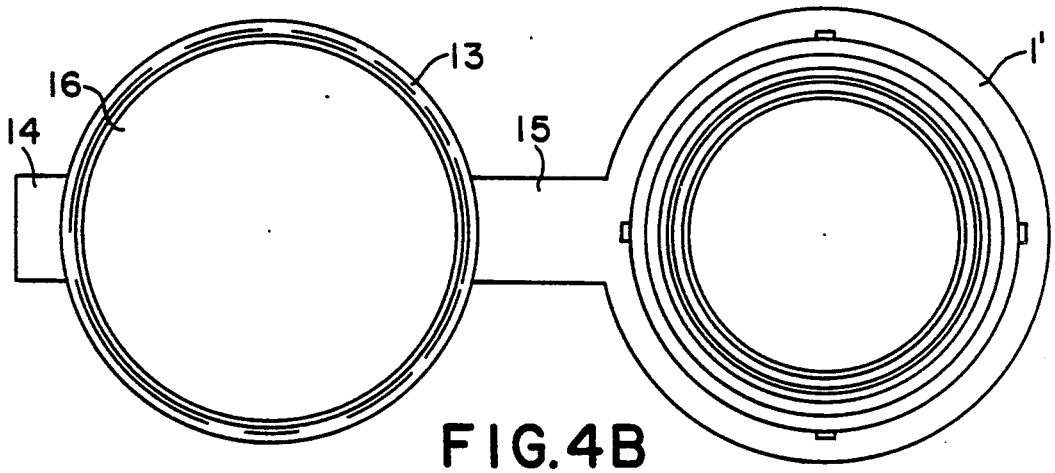
FIG. 4B

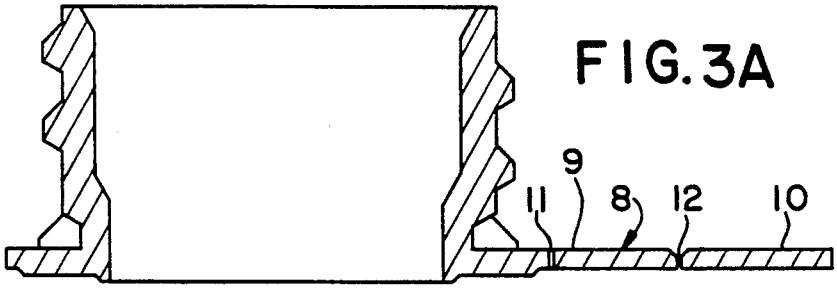
FIG.3A
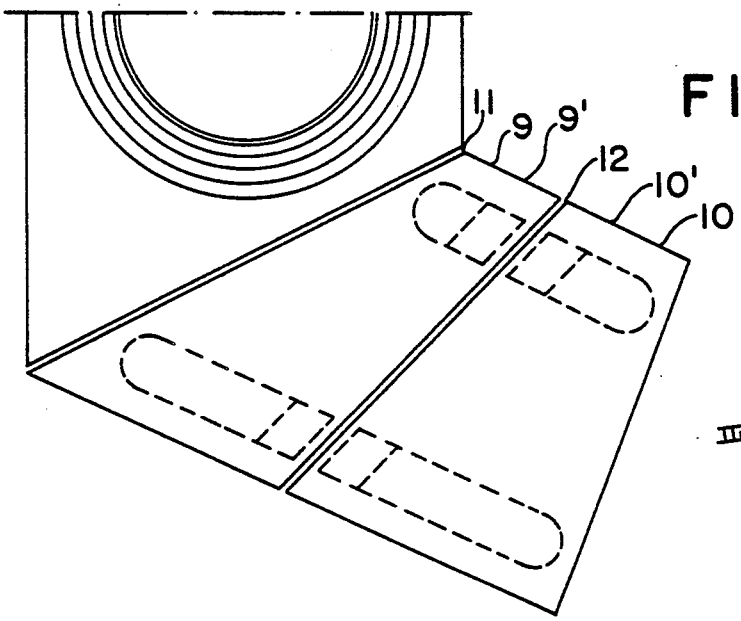
FIG.3B
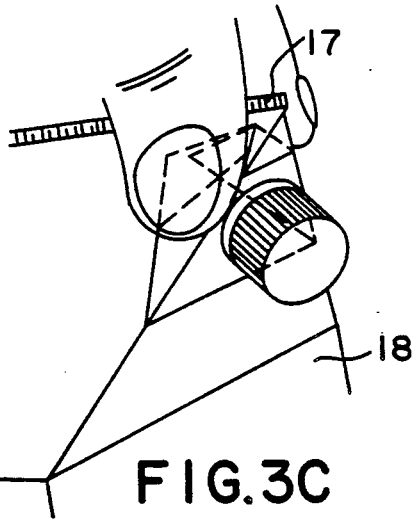
FIG.3C
FIG.4C
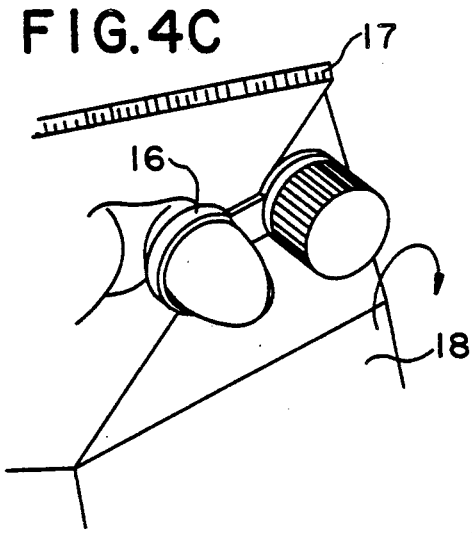
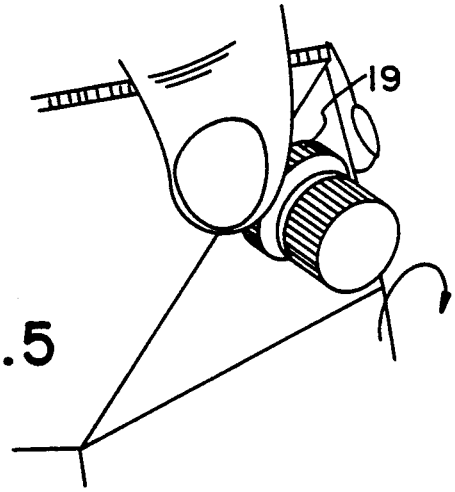
FIG.5

OPENING-CLOSING DEVICE FOR A BAG OF FLEXIBLE SYNTHETIC MATERIAL HAVING A FINGER GRIPPING PORTION

The present invention relates to an opening-closing device intended to be used in combination with a flexible bag in particular for the packaging of liquids, of the type comprising a sealing and pouring assembly composed of a cylindrical spout and a stopper interacting with the said drum and equipped with means for cutting out and perforating the wall of the said bag by means of screwing or pressure to permit the opening thereof.

Devices of this type are known per se.

They formed the subject, for example, of U.S. Pat. 4,440,316 and also of French Patent Applications 85-13204 and 86-09702 in the name of the applicant.

The flexible bags in question formed the subject, this being non-limiting, for example, of French Patent Application 83-18257, also in the name of the applicant.

In the case of bags equipped with an opening-closing device of the type described above, it is necessary to hold the top corner of the bag with one hand during the screwing of the stopper, which screwing brings about the perforation of the film forming the wall of the bag at this place.

This solution is rather impractical for the majority of users.

Moreover, there is a risk, with careless handling, of the teeth of the stopper piercing the opposite wall, which makes the bag unusable after a first use.

The object of the present invention is to overcome these disadvantages by proposing a device in which there exists a rigid, or semi-rigid, means for gripping both during the perforation and which prevents the perforation of the wall opposite the said perforation.

In accordance with the invention, this result is obtained with an opening-closing device intended to be used in combination with a flexible bag in particular for the packaging of liquid, of the type comprising a sealing and pouring assembly composed of a cylindrical spout and a stopper interacting with the said spout and equipped with means for cutting out and perforating the wall of the said bag by means of screwing or pressure to permit the opening thereof, characterized in that the spout comprises a means extending radially with respect to the latter and enabling the user to grip when the said wall is pierced.

Advantageously, the said means will be integral with the spout.

According to one embodiment, the said means will consist of a tongue.

In an alternative embodiment, the said means will consist of two triangular, preferably symmetrical, tongues.

According to a further embodiment of the invention, the said tongue will be integral with the spout and will be composed of the protective ring as well as of its tab for attachment to the spout.

Finally, it will be possible, in the case of a double tongue, to provide for the latter to be sufficiently flexible or each equipped with a line of weakening to allow the folding of their ends towards the back of the spout, at the same time as gripping, so as to limit the travel of the teeth of the stopper.

The invention will be better understood with the aid of the description below which is given with reference to the attached drawings, in which:

FIGS. 2A and 2B are alternative embodiments of the preceding figures;

FIG. 3A is a partial view in longitudinal section of a further embodiment with limitation of the penetration of the stopper;

FIG. 3B is a plan view of the device of FIG. 3A;

FIG. 3C illustrates the operation of the said embodiment;

FIG. 4A is a view in longitudinal section of a device according to the invention in which the gripping means is the protective ring;

FIG. 4B is a plan view of the device of FIG. 4A;

FIG. 4C illustrates the operation of the said embodiment;

FIG. 5 is an alternative embodiment in which the device is a reinforcement of the shoulder of the spout.

FIG. 1A shows a device composed of a spout (1) equipped with a thread (2) fitted to a bag of which there is shown a wall (3) which is to be torn by a stopper screwed onto the spout (1) and equipped with cutting teeth.

Figure 1A:
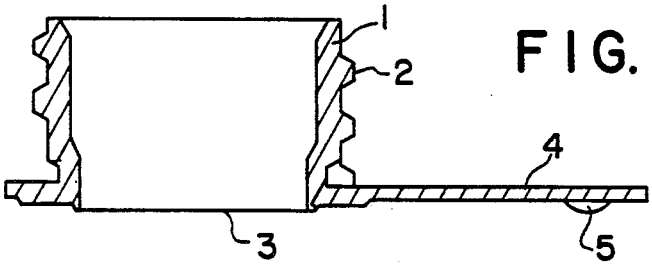
FIG. 1A is a view in longitudinal section of a device according to the invention.
Figure 1B:
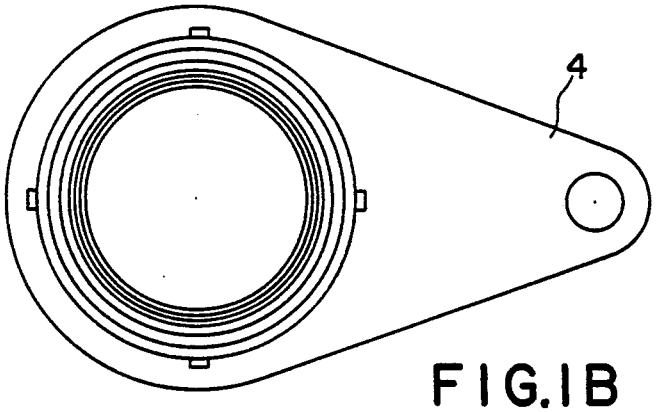
FIG. 1B is a plan view of the device of FIG. 1A.
Figure 1C:
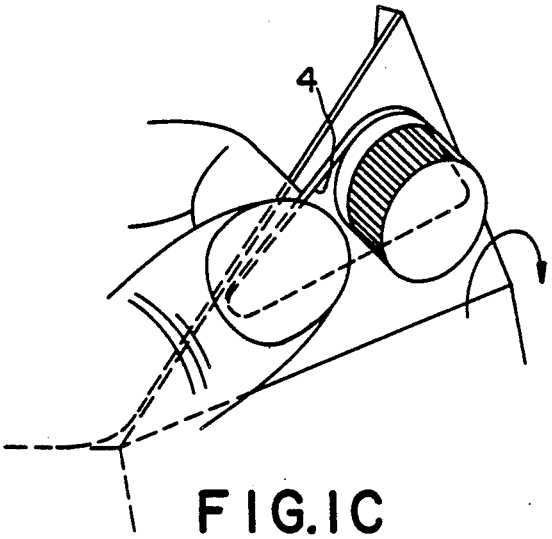
FIG. 1C illustrates the operation of the said device, with an alternative form of gripping 1D.
Figure 1D:
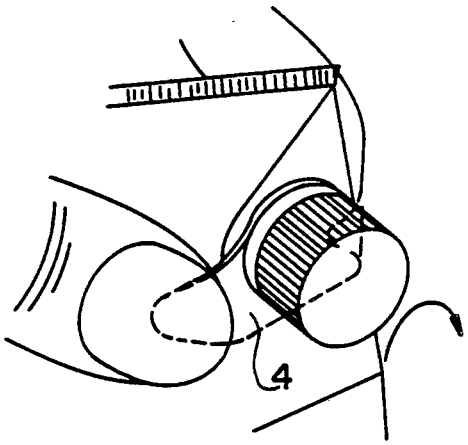

For gripping the bag, which is flexible, a tongue (4) of general triangular shape with rounded corners is used as the means, as shown more clearly in FIG. 1B. Thus, the user holds the tongue (4) with one hand and imparts a rotational movement to the stopper using his other hand, which brings about the perforation of the wall (3), and consequently the opening of the flexible bag and the possibility of pouring out the contents thereof.

It will be possible to provide on the tip of the tongue a boss (5) which will help the user to grip.

In the alternative embodiment of FIGS. 2A and 2B, the structure is identical but double, that is to say there are two symmetrical tongues (6,7) of similar structure to the previous one.

In this structure the tongues can be taken between the fingers of a single hand and folded back. They then also ensure, besides gripping, that there is no perforation of the opposite wall, which will be explained in the case of the following alternative embodiment.

FIGS. 3A, 3B and 3C show in fact an alternative embodiment in which each lateral wing (8), of which there are two, is composed of trapezoidal sectors (9,10) the small bases (9,,10,) of which are arranged towards the top corner (17) of the bag (18) shown in FIG. 3C.

The sectors are connected to each other by lines of lower resistance (11,12). The line (12) will permit an actual articulation of the sector (10) with the sector (9) and the line (11) between the sector (9) and the actual shoulder.

Advantageously, the sector (10) will be striated or ribbed to facilitate gripping.

The lines (11) and (12) are also introduced at the product manufacturing stage.

In addition, the line (11) serves to fold over the corner before use.

In this way, the user can grasp the sectors between his fingers as shown in FIG. 3C, which produces the gripping and also limits the penetration of the teeth of the stopper, thus preventing the perforation of the opposite wall of the bag.

FIGS. 4A and 4B illustrate an embodiment in which the spout (1) is integral with a protective ring (13) comprising a gripping tongue (14), the said ring being connected to the said spout by a flexible connecting strip (15).

This arrangement works as follows To open the bag and perforate it, the user unscrews the stopper. Then he releases the protective ring by taking it by the tongue (14) and passing his finger through the orifice (16) in the said ring, which may have a gripping point enabling him to screw the stopper onto the spout to pierce the wall of the film.

Finally, in the alternative embodiment of FIG. 5, the device consists of an annular reinforcement (19) at the base of the spout, which the user can take hold of.

I claim:

1. An opening-closing device for a flexible bag adapted to hold a liquid, comprising:

a cylindrical spout defining an opening therethrough, the spout being attached to an outer surface of the bag so that a perforable wall is defined in an area of the surface of the bag encompassed by the opening; and at least one tongue integral with and extending radially from the spout, the tongue having a generally triangular shape with rounded corners, whereby a user may grip the tongue.

2. An opening-closing device for a flexible bag adapted to hold a liquid, comprising:

a cylindrical spout defining an opening therethrough, the spout being attached to an outer surface of the bag so that a perforable wall is defined in an area of the surface of the bag encompassed by the opening;

a stopper, adapted to close the opening in the spout, further including means for perforating the perforable wall in the spout when at least a portion of the stopper is inserted in the opening in the spout; and at least one tongue integral with and extending radially from the spout, the tongue having a generally triangular shape with rounded corners, whereby a user may grip the tongue.

3. An opening-closing device as in claim 2, further including a gripping boss on the tongue.

4. An opening-closing device as in claim 2, wherein said at least one tongue comprises two tongues arranged symmetrically on the spout.

5. An opening-closing device for a flexible bag adapted to hold a liquid, comprising:

a cylindrical spout defining an opening therethrough, the spout being attached to an outer surface of the bag so that a perforable wall is defined in an area of the surface of the bag encompassed by the opening; and two lateral wings extending from and integral with the spout, each wing including at least two trapezoidal sectors, the trapezoidal sectors of the two wings having small bases arranged toward a common direction, whereby a user may grip the wings.

6. An opening-closing device as in claim 5, wherein the sectors are foldable relative to each other.

7. An opening-closing device as in claim 5, wherein the small bases of the trapezoidal sectors are arranged toward an adjacent corner of the bag.

8. An opening-closing device for a flexible bag adapted to hold a liquid, comprising:

a cylindrical spout defining an opening therethrough, the spout being attached to an outer surface of the bag so that a perforable wall is defined in an area of the surface of the bag encompassed by the opening;

a stopper, adapted to close the opening in the spout, further including means for perforating the perforable wall in the spout when at least a portion of the stopper is inserted in the opening in the spout; and two lateral wings extending from and integral with the spout, each wing including at least two trapezoidal sectors, the trapezoidal sectors of the two wings having small bases arranged toward a common direction, whereby a user may grip the wings.

9. An opening-closing device as in claim 8, wherein the sectors are foldable relative to each other.

10. An opening-closing device as in claim 8, wherein the small bases of the trapezoidal sectors are arranged toward an adjacent corner of the bag.

11. An opening-closing device as in claim 8, wherein the trapezoidal sectors of each wing are attached to each other and to the spout by lines of lower resistance.

12. An opening-closing device as in claim 8, wherein the sectors are ribbed.

13. An opening-closing device as in claim 8, wherein the sectors are striated.

14. An opening-closing device for a flexible bag adapted to hold a liquid, comprising:

a cylindrical spout defining an opening therethrough, the spout being attached to an outer surface of the bag so that a perforable wall is defined in an area of the surface of the bag encompassed by the opening;

a stopper, adapted to close the opening in the spout, further including means for perforating the perforable wall in the spout when at least a portion of the stopper is inserted in the opening in the spout; and a protective ring having a gripping tongue attached to the spout by a flexible connecting strip, the protective ring being dimensioned to fit around the outside of the spout.

* * * * *